US008376751B2

(12) United States Patent
Ranciato

(10) Patent No.: US 8,376,751 B2
(45) Date of Patent: Feb. 19, 2013

(54) SPORTS TRAINING DEVICE FOR HEAD AND NECK MOVEMENT

(76) Inventor: Craig Ranciato, Palm Coast, FL (US)

( * ) Notice: Subject to any disclaimer, the term of this patent is extended or adjusted under 35 U.S.C. 154(b) by 630 days.

(21) Appl. No.: 12/543,366

(22) Filed: Aug. 18, 2009

(65) Prior Publication Data

US 2011/0045449 A1 Feb. 24, 2011

(51) Int. Cl.
*A63B 69/36* (2006.01)

(52) U.S. Cl. ..... 434/252

(58) Field of Classification Search ..... 434/247, 434/252; 2/10; 473/207, 208, 210, 211
See application file for complete search history.

(56) References Cited

U.S. PATENT DOCUMENTS 1,980,101 A * 11/1934 Schneider ..... 2/10
2,440,878 A * 5/1948 Schneider ..... 2/10
3,156,211 A * 11/1964 Mallory, Jr. ..... 473/211
3,437,339 A * 4/1969 Starck ..... 473/210
3,594,007 A * 7/1971 Kalberer ..... 473/211
3,819,189 A * 6/1974 Goode ..... 473/210
3,992,011 A 11/1976 Jessee
4,098,509 A * 7/1978 Van Krevelen ..... 473/211
4,531,743 A * 7/1985 Lott ..... 473/210
5,171,152 A * 12/1992 McCleery ..... 473/210
5,409,232 A 4/1995 Hoganson
5,511,789 A 4/1996 Nakamura
5,538,250 A * 7/1996 Putz ..... 473/210
5,752,887 A * 5/1998 Baldwin, IV ..... 473/210
5,842,931 A 12/1998 Payne
6,390,823 B1 * 5/2002 Wesenhagen ..... 434/252
7,458,901 B2 12/2008 Hoganson

* cited by examiner

*Primary Examiner* — Kurt Fernstrom
(74) *Attorney, Agent, or Firm* — Daniel Law Offices, P.A.; Jason T. Daniel, Esq.

(57) ABSTRACT

An apparatus and method for detecting and correcting improper head neck and back movement during sports. The apparatus may include a non-reflective shield positioned near at least one eye of a user. The shield may be oriented at an angle parallel to a users' vision while in the open position, and the shield may be oriented at an angel perpendicular to a users' vision while in the closed position. Additionally, a swing arm or movement response unit may move the position of the shield from open to closed in response to the movement of a user.

14 Claims, 5 Drawing Sheets

SPORTS TRAINING DEVICE FOR HEAD AND NECK MOVEMENT

BACKGROUND

1. Field of the Invention

The present invention relates generally to a system, method and apparatus for detecting and correcting improper head and neck movement during sports.

2. Description of the Related Art

One of the most important features of a good sports swing is to minimize movement of the head and neck so as to ensure solid contact with the ball. This is particularly important in golf, where improper head movement during a swing is a common error experienced by novice golfers. This movement may be lateral movement of the head in a direction that is generally parallel with the intended line of flight of the golf ball. The movement may also be from front to back relative to the golfer's body, or it may be in an up and down direction. Since there are several possible types of movement of the golfer's head, it is difficult to monitor.

Many different devices have been proposed for monitoring a golfer's head movement. For example, U.S. Pat. No. 5,409,232 describes a golf ball support means in which narrow light beams are generated toward the rear of a ball so as to be visible to a golfer during his swing. However, this device can be distracting, as a golfer will have to split their concentration between the ball, their swing and the lights projecting from the ball.

U.S. Pat. No. 3,992,011 discloses a hollow tee through which light shines. The golfer takes his stance and initially observes the light beam. A ball is then placed on the tee and the golfer swings to knock the ball off of the tee. After the swing is completed, the golfer re-observes the light to check and see if he has held his head still. However, this device provides information as to head position only after the golf ball has been struck, and it may be difficult to determine just what type of movement has taken place.

Accordingly, it would be beneficial to provide a method and device in which a user can be immediately notified of improper head or neck movement without requiring the user to divert their attention from the ball during a swing. It is also an objective of the invention to provide a training device which is simple to use, and which is economical to manufacture and assemble.

SUMMARY OF THE INVENTION

The present invention is directed to a sports training device for indicating improper head and neck movement. One embodiment of the present invention can include a non-reflective shield for reducing a peripheral vision of a user and an adjustable headgear support unit for positioning the non-reflective shield near the eyes of a user. The embodiment may further include a movement response unit for changing the orientation of the non-reflective shield in response to a movement of the user.

Another embodiment of the present invention can include a device comprising a non-reflective shield, a headgear support unit, and a movement response unit for adjustably connecting the non-reflective shield to the headgear support unit.

Yet another embodiment of the present invention can include a method for indicating improper head and neck movement. The method can include positioning a non-reflective shield near an eye of a user, reducing a peripheral vision of the user, detecting a movement of a user that exceeds a predetermined magnitude, and changing the position of the non-reflective shield in response to the movement.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Figure 1:
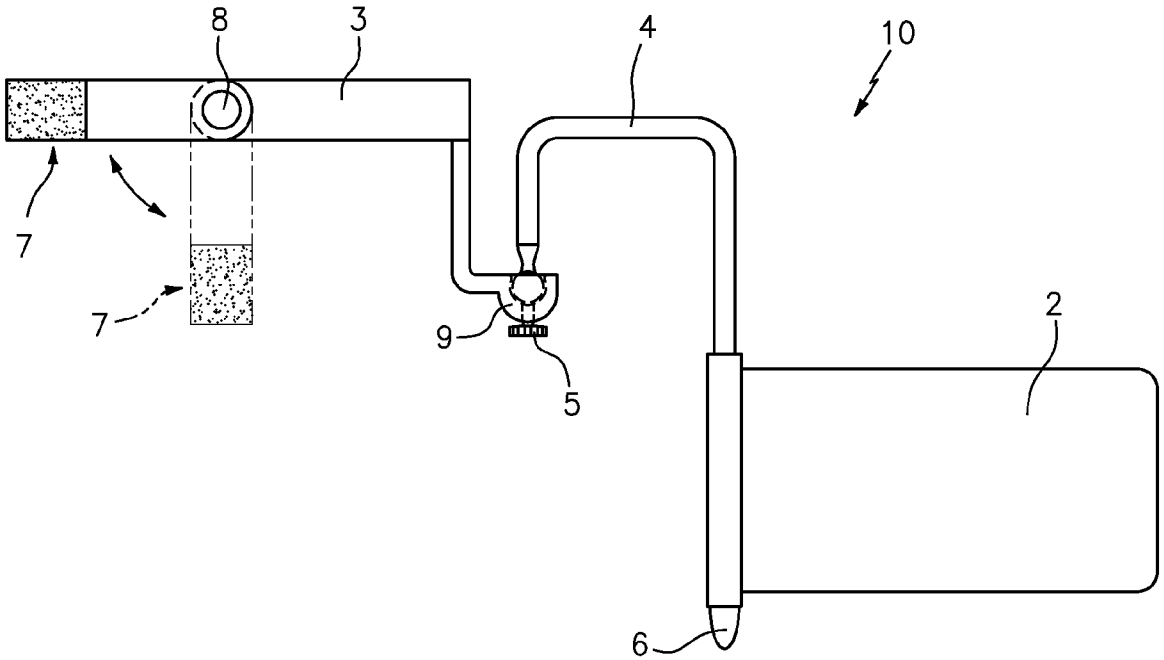
FIG. 1 is a frontal elevation of a sports training device that is useful for understanding the embodiments disclosed herein.

Referring to FIG. 1, a sports training device 10, according to one embodiment includes a shield 2, an attachment clip 3 and a swing arm 4.

The shield 2 works to limit the peripheral vision of a user such that concentrating on the ball is made easier. By reducing the peripheral vision of a user, the device also acts to train a user to not prematurely lift their head to watch the flight of the ball. To this end, the shield 2 can take virtually any shape including a rectangle, square, oval or may be designed to fit the contour of a face. Additionally, the shield 2 can be opaque or can further contain specific markings. These markings can be distance or position indicators to allow a user to better align their stance with a ball or a particular location to which the user intends the ball to travel. The shield 2 may be plastic, metal, composite or virtually any other light weight shatter-resistant material.

In one exemplary embodiment, the shield 2 may additionally contain a pointer 6 which projects a visual reference for the user.

The attachment clip 3 works to secure the device 10 to a user. The term clip is not intended to be limiting as the end portion 7 of the clip 3 may perform this function via spring or mechanical pressure, adhesive, magnetic or may attach to an object and be held in place by gravity. As such, the clip works to secure the device 10 to a user or other object that is located about the head or neck of the user such that the shield 2 is positioned near at least one eye of the user. The clip 3 further includes a locking hinge 8, which acts to rotate the end portion 7, thus allowing the clip 3 to attach to a wide variety of objects that may typically be worn about the head or neck of a user.

The swing arm 4 connects the clip 3 to the shield 2. In one embodiment, the swing arm 4 will position the shield 2 to remain parallel with the users' forward field of vision. During this time, the swing arm 4 is in the open position and acts to reduce the peripheral vision of the user. By positioning the shield 2 in this manner, the device 10 advantageously reduces the users' ability to observe movement events occurring around them and thus allows the user to better concentrate on the ball. In another embodiment, the swing arm 4 is configured to orient the shield 2 to block the forward vision of the user, i.e. to be perpendicular to a users' forward field of vision. At this time, the swing arm is in the closed position. The swing arm 4 can be configured to change the position of the shield 2 from the open position to the closed position in response to detecting movement of the user. The momentum resulting from this movement (such as lateral movement of the head) may be sufficient to physically change the position of the shield 2 on its own. Alternatively, the swing arm 4 may utilize a spring, or other mechanical assisted device 9, to change the position of the shield 2 upon detecting movement that exceeds a predetermined threshold. In a further embodiment, the device 10 can include one or more adjustment dials 5 which allow a user to adjust the threshold of the swing arm 4 to change the position of the shield 2 based on a users preference. As stated above, the mechanical assisted device 9 is not limited to using a spring and may incorporate a ball and socket configuration, a generic hinge, magnetism or other known hinge device.

Figure 2:
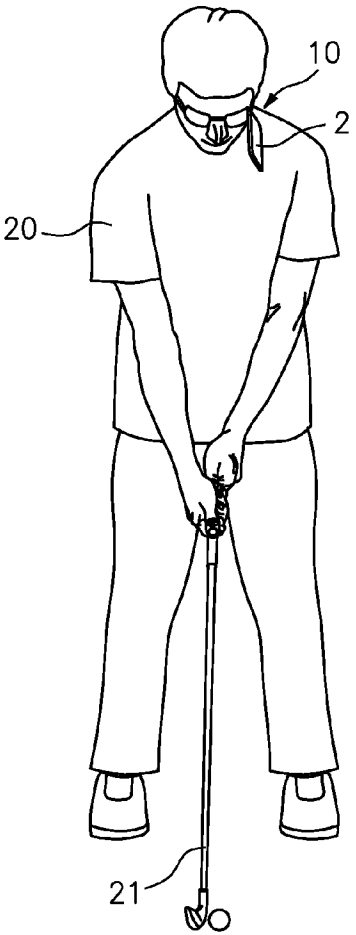
FIG. 2 is a frontal view of a golfer using the invention.

FIG. 2, illustrates the sports training device 10 in action. According to this embodiment, the device 10 is positioned in the open position about the head of a user 20, such that the shield 2 is parallel to the forward vision of the user. At this time, the shield has the added benefit of preventing the user from noticing movement in his or her peripheral vision, thus improving concentration. When the user 20 swings the club 21 while maintaining proper form (i.e. minimal head neck and/or back movement) the shield 2 remains in the open position throughout the swing.

Figure 3:
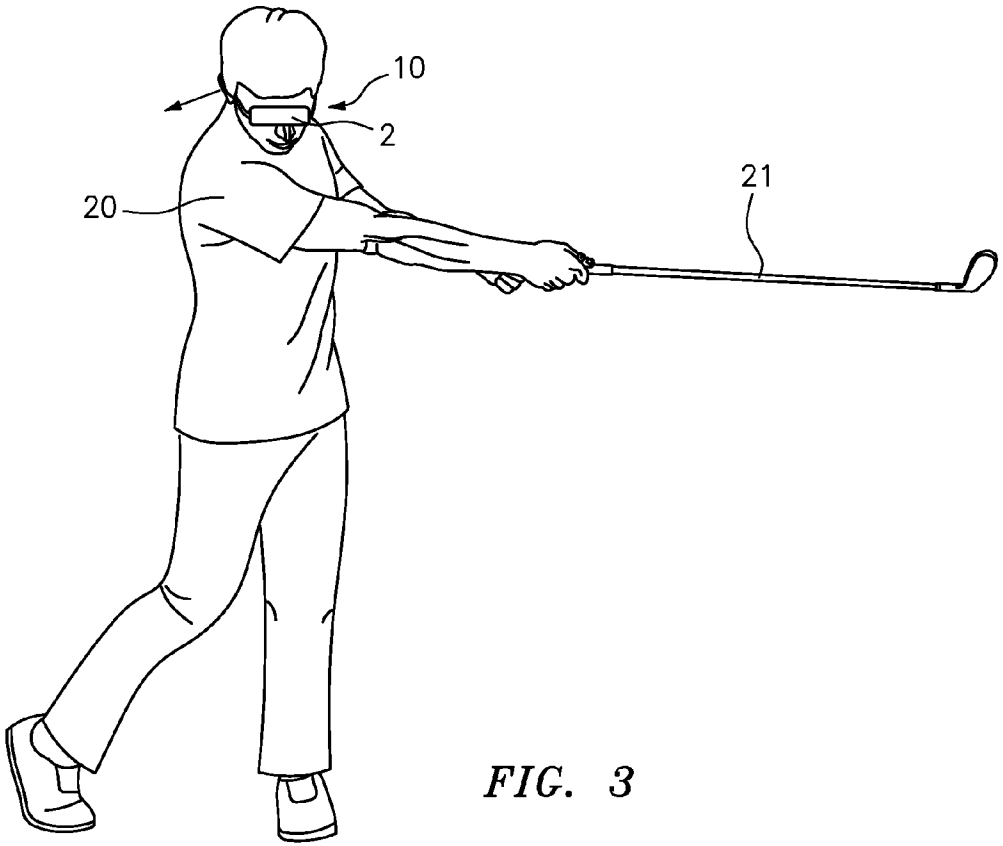
FIG. 3 is another frontal view of a golfer using the invention.

However, as illustrated in FIG. 3, when the user 20 swings the club 21 with an improper form (i.e. head neck and/or back movement that exceeds a predetermined threshold) the shield 2 is rotated perpendicular to the forward vision of the user, thus requiring the user to abandon the current swing and try again.

Figure 4:
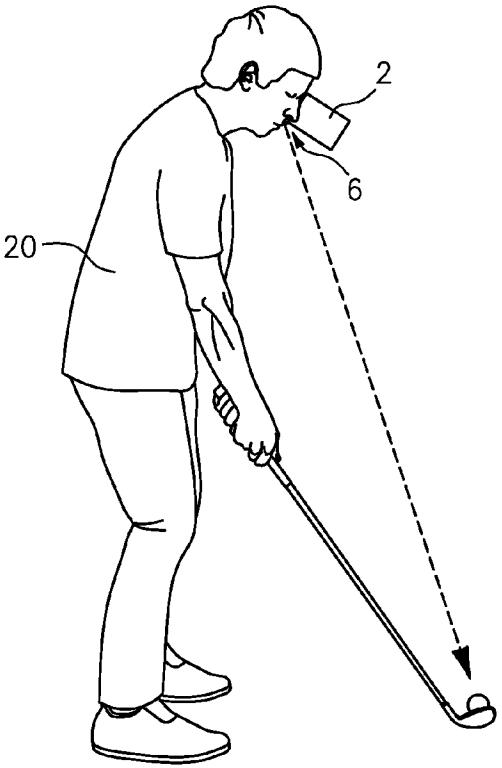
FIG. 4 is perspective view of an additional embodiment of the invention.

FIG. 4 illustrates another embodiment in which the device 10 includes a pointer 6. The pointer 6 acts to visually guide the user 20 to stand in a correct orientation with respect to the ball 22. Although FIG. 4 illustrates the location of the pointer 6 to be on the shield 2, one of skill in the art would recognize that the pointer 6 could be located anywhere on the device 10 and that the pointer may incorporate a light such as a laser, led or other such visual aid.

Figure 6:
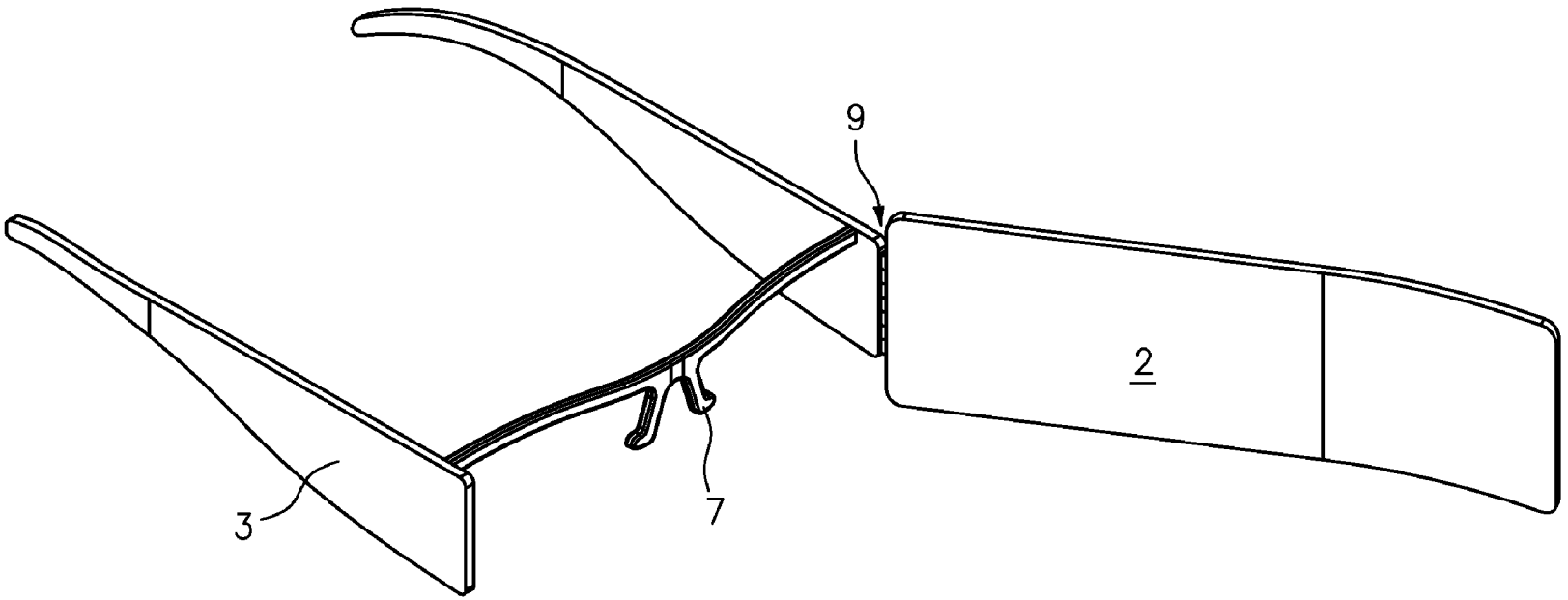
FIG. 6 is perspective view of the sports training device, in accordance with another embodiment of the invention.

Although the above figures illustrate the device used in combination with glasses, one of skill in the art would recognize that the device can be removably attached to virtually any item typically worn about the head or neck of a user (i.e. hat, sunglasses, headband, etc.). Additionally, the sports training device 10 may be permanently attached during the initial manufacturing of any one of these other items in order to be marketed and sold as a single integrated training aid, as illustrated in FIG. 6.

Figure 5:
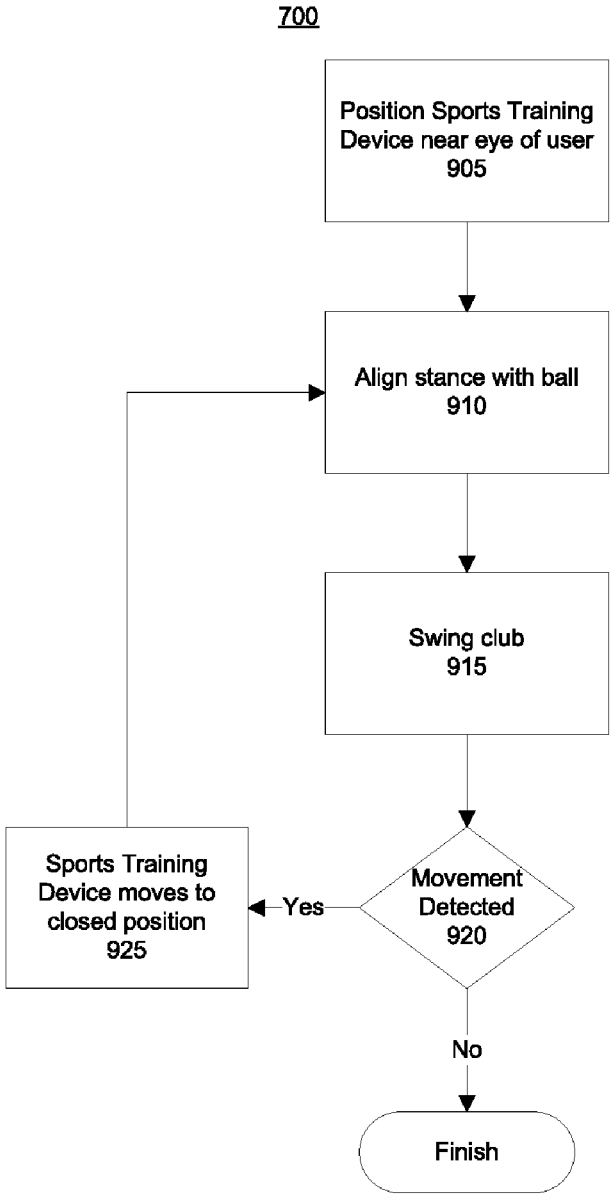
FIG. 5 is a flow chart illustrating a method of indicating improper head and neck movement in accordance with the present invention.

FIG. 5 is a flow chart illustrating a method 700 for indicating improper head and neck movement.

Accordingly, in step 905 a sports training device is positioned about the head of a user such that the shield is near at least one eye of the user.

In step 910, a user aligns their stance with a ball and prepares to swing.

In step 915, a user swings their club.

In step 920, if movement about the neck or head is not detected in step 915, the sports training device remains in the open position and the user completes their swing.

In step 925, if movement about the neck or head is detected in step 915, the sports training device moves to the closed position, and the user terminates their swing and returns to step 910.

This invention can be embodied in other forms without departing from the spirit or essential attributes thereof. Accordingly, reference should be made to the following claims, rather than to the foregoing specification, as indicating the scope of the invention.

What is claimed is:

1. A sports training device for indicating improper head and neck movement, said device comprising:

an elongated, generally opaque shield;

an attachment clip having a first end portion configured to attach to at least one of a user and an article worn about the head and neck of the user; and a swing arm consisting of a hinge that is interposed between a second end portion of the attachment clip and the shield, said swing arm being configured to transition the shield between an open position and a closed position, and said shield being positioned to limit a peripheral vision of the user in the open position, and to limit a forward vision of the user in the closed position.

2. The sports training device of claim 1, wherein the swing arm is configured to transition between the open position and the closed position in response to a lateral movement of the user's head.

3. The sports training device of claim 2, further comprising:

at least one adjustment control device configured to specify a minimum amount of lateral movement necessary to transition between the open and closed positions.

4. The sports training device of claim 1, wherein the shield further includes markings configured to align the user with a golf ball.

5. The sports training device of claim 1, further comprising:

an alignment unit configured to project a visual cue for aligning a user's stance with a ball.

6. The sports training device of claim 1, wherein the shield is positioned alongside one eye of the user and extends outward into a generally parallel orientation with the forward vision of the user in the open position, and the shield is positioned in a generally perpendicular orientation with the forward vision of the user in the closed position.

7. A sports training device for indicating improper head and neck movement, said device comprising:

an elongated, generally opaque shield;

an eyepiece frame configured to be worn on the head of a user; and a swing arm consisting of a hinge that is in communication with the frame and the shield, said swing arm being positioned on a single side portion of the frame, and configured to transition the shield between an open position and a closed position, and said shield being positioned to limit a peripheral vision of the user in the open position, and to limit a forward vision of the user in the closed position.

8. The sports training device of claim 7, wherein the swing arm is configured to transition between the open position and the closed position in response to a lateral movement of the user's head.

9. The sports training device of claim 8, further comprising:

at least one adjustment control device configured to specify a minimum amount of lateral movement necessary to transition between the open and closed positions.

10. The sports training device of claim 7, wherein the shield further includes markings configured to align the user with a golf ball.

11. The sports training device of claim 7, further comprising:

an alignment unit configured to project a visual cue for aligning a user's stance with a ball.

12. The sports training device of claim 7, wherein the shield is positioned alongside one eye of the user and extends outward into a generally parallel orientation with the forward vision of the user in the open position, and the shield is positioned in a generally perpendicular orientation with the forward vision of the user in the closed position.

13. A method for indicating improper head and neck movement, said method comprising:

positioning a non-reflective shield near one eye of a user;

detecting a lateral movement of a user's head; and transitioning the non-reflective shield between an open position and a closed position in response to said movement, wherein the shield is positioned to limit a peripheral vision of the user in the open position, to limit a forward vision of the user in the closed position.

14. The method of claim 13, further comprising:

aligning a user's stance with a ball via a visual alignment means.

* * * * *